US006532872B2

(12) United States Patent
Siegl et al.

(10) Patent No.: US 6,532,872 B2
(45) Date of Patent: Mar. 18, 2003

(54) GOOD REGISTER COORDINATION OF PRINTING CYLINDERS IN A WEB-FED ROTARY PRINTING PRESS

(75) Inventors: Walter Siegl, Bern (CH); Andreas Helfenstein, Bern (CH)

(73) Assignee: Maschinenfabrik Wifag (CH)

( * ) Notice: Subject to any disclaimer, the term of this patent is extended or adjusted under 35 U.S.C. 154(b) by 50 days.

(21) Appl. No.: 09/863,780

(22) Filed: May 22, 2001

(65) Prior Publication Data

US 2002/0023560 A1 Feb. 28, 2002

Related U.S. Application Data

(63) Continuation of application No. 09/088,303, filed on Jun. 1, 1998, now abandoned.

(30) Foreign Application Priority Data

Jun. 2, 1997 (DE) ..... 197 23 043
Jun. 2, 1997 (DE) ..... 197 23 059

(51) Int. Cl.[7] ..... B41F 13/24
(52) U.S. Cl. ..... 101/483; 101/248; 700/29
(58) Field of Search ..... 101/483, 484, 101/485, 151, 248, 211, 232, 181, 216; 700/28, 29, 33, 37, 38, 63, 45

(56) References Cited

U.S. PATENT DOCUMENTS 4,264,957 A * 4/1981 Pautzke ..... 101/248
4,569,584 A * 2/1986 St. John et al. ..... 101/151
4,592,320 A 6/1986 Peter et al.
4,698,745 A * 10/1987 Hiroi et al. ..... 700/37
4,714,988 A * 12/1987 Hiroi et al. ..... 700/38
5,043,904 A * 8/1991 Sikes et al. ..... 101/248
5,091,844 A * 2/1992 Waltz ..... 700/33
5,119,288 A * 6/1992 Hiroi ..... 700/63
5,361,960 A * 11/1994 Fokos et al. ..... 101/248
5,535,117 A * 7/1996 Hiroi ..... 700/37
5,625,551 A * 4/1997 Mitarai et al. ..... 700/29
5,638,267 A * 6/1997 Singhose et al. ..... 700/28
5,687,077 A * 11/1997 Gough, Jr. ..... 700/29
5,841,478 A * 11/1998 Rhoads ..... 101/483

FOREIGN PATENT DOCUMENTS

DE 196 39 014 A1 4/1998
EP 0 644 048 A2 3/1995

* cited by examiner

*Primary Examiner*—Eugene H. Eickholt
(74) *Attorney, Agent, or Firm*—McGlew and Tuttle, P.C.

(57) ABSTRACT

The present invention pertains to the coordination in good register of cylinders of a web-fed rotary printing press which print on a web, wherein a first cylinder printing on one side of the web is driven by a first motor and a second cylinder printing on the same side of the web is driven by a second motor and the angular position of the second cylinder is coordinated with the first cylinder in good register by a controller. At least one disturbance variable (v) is sent to a command variable ($u_{2,Soll}$) for the motor controller of at least the second cylinder to compensate a register deviation ($Y_{12}$) of the second cylinder from the first cylinder, which register deviation is typical of the said disturbance variable (v).

19 Claims, 12 Drawing Sheets

GOOD REGISTER COORDINATION OF PRINTING CYLINDERS IN A WEB-FED ROTARY PRINTING PRESS

RELATED APPLICATIONS

This is a Continuation of application Ser. No. 09/088,303 now abandoned filed Jun. 1, 1998, and the entire disclosure of this prior application is considered to be part of the disclosure of the accompanying application and is hereby incorporated by reference therein.

FIELD OF THE INVENTION

The present invention pertains to a process and to a device for coordinating in good register cylinders of a web-fed rotary printing press which print on a web.

BACKGROUND OF THE INVENTION

The ability to change over from one production to the next as rapidly as possible and with the smallest possible amount of waste as possible plays an increasing role in web-fed rotary printing. Newspapers and journals are increasingly tailored to the local needs or to certain target groups, so that even though the number of editions increases, the volume of the individual editions decreases. The significance of production change increases to achieve economy of the printing press.

Designs of printing presses which can be configured in a flexible manner and at the same time contribute to keeping the purchase cost low despite increased flexibility, have been known from the applicant's EP 0 644 048 A2. The designs of the individually driven print positions described there for rubber/rubber and steel/rubber productions make possible a flying plate change during continuous production. Printing cylinders that are not needed in the current production are moved on and up during the running production here and are brought into contact with counterpressure cylinders when a preset circumferential velocity is reached, so that the new print positions are formed for the next production. The new printing positions or printing gaps, which are formed between two cylinders printing on the web, i.e., between printing cylinders, are on the path of the web of the still running production. The web does not have to be pulled in again. Cylinders of print positions of the still running production which are no longer needed are pivoted away. The new production begins and joins the preceding one in a seamless manner. It is no longer necessary with these prior-art printing presses and printing press designs to bring the press to a stop at the time of a change in production and to start it up from the stop, so that the changeover times can be considerably reduced, in the ideal case to zero.

In flying plate change, e.g., in the case of changes in the web width, and the flying production change made possible by it, the circumferential velocity of the printing cylinders for the preceding old production is first reduced in most cases to a preset value, e.g., to 30% of the velocity occurring in the production run, and the new cylinders are engaged with their counterpressure cylinders after the same circumferential velocity has been reached. The new production is assumed at this velocity. The cylinders that now form the print positions are subsequently accelerated to the velocity of the production run. In the case of a change in production, two velocity ramps are thus passed through in this case. The drive design of the printing presses described in the above-mentioned documents with individually driven printing units also makes it possible, compared with the previously usual drives with a common shaft, a considerably more rapid passage through the velocity ramps, so that the changeover times between two productions can be reduced even more.

SUMMARY AND OBJECTS OF THE INVENTION

The primary object of the present invention is to improve the registry and consequently the quality of the printed image on a printed web.

This object is accomplished by printing on one side of the web with first and second cylinders. The cylinders are driven with first and second motors, where motor controllers are used for maintaining preset angular positions of the first and second cylinders. A disturbance variable (v) is sent to a command variable ($u_{2,Soll}$) for the motor controller the second cylinder to compensate a register deviation ($Y_{12}$) of the second cylinder from the first cylinder. The register deviation being typical of the disturbance variable (v).

The present invention is based on web-fed rotary printing presses, especially the offset printing of newspapers, as they have been known from, e.g., EP 0 644 048 A2. A first cylinder printing on one side of a web is driven by a first motor, and a second cylinder printing on the same side of the web is driven by a second motor, i.e., there is no mechanical coupling between the first and second cylinders for a common drive by a common motor. The two motors are not connected in a positive-locking manner for purposes of drive. Both motors are controlled with respect to the angular position of the cylinders driven by them.

A disturbance variable is sent according to the present invention to the motor controller of the motor for the second cylinder. Major deviations in the circumferential register, i.e., register errors or register deviations which would otherwise occur without such an additional sending are counteracted by the additionally sent disturbance variable. The circumferential velocity of the cylinder or a variable from which the circumferential velocity can be determined is preferably used as the disturbance variable. The circumferential velocity or the equivalent variable is preferably measured at each of the cylinders and is sent to that cylinder or is measured representatively for the cylinders to be coordinated with one another in good register at one of these cylinders and is sent to each of the other cylinders. A control member forms from this a disturbance variable that is to be sent based on a stored, velocity-dependent characteristic.

Thus, even though the angular position of the cylinders is conventionally controlled and regulated in terms of a synchronous run during the passage through velocity ramps and also during the production run, the accidental and foreseeable changes in the behavior of the web during the operation are not taken into account. For example, the pull of the web is a function, among other things, of the velocity of the web. Such changes in the behavior of the web, which also occur especially during nonstationary operation and cause intolerable register errors, are compensated by the sending according to the present invention of an additional disturbance variable to the setting variable of the register controller or directly to the command variable for a motor controller or they are not allowed to occur in the first place. Each of the motors is thus controlled on the basis of the conventional command variable, e.g., the absolute angular position. At least the motor for the cylinders to be coordinated is, moreover, controlled on the basis of the additionally sent disturbance variable to compensate a foreseeably changing web behavior.

The disturbance variable, which is to be sent at discrete times or continuously, especially during the passage through velocity ramps, may be determined empirically or by simulation or a combined method.

In the case of an empirical method, all the velocity ramps that can be planned and are possible during the later operation are passed through for the given type of press. The printed copies produced in the process can be delivered and the register marks can be measured. The velocity ramps are passed through in steps, such that one passes over into production run at preset times during a phase of acceleration or deceleration at the cylinder circumferential velocity just reached and the register marks thus printed are measured and evaluated. This procedure is followed at each step of the velocity ramp. Discrete values for register errors and register deviations are obtained from the evaluation, and the values for the disturbance variable to be additionally sent, with which the register error, which would otherwise occur without the sending of the disturbance variable, is compensated, are determined from these. Interpolation is possible between the discrete values obtained by this manner of measurement for the register deviation, and a continuous, preferably constant curve of the register deviation over the circumferential velocity of the cylinder can be obtained as a result. However, the disturbance variable may also be sent in discrete steps.

The ink register-measuring devices present in the press for automatic measurement are advantageously used for this purpose in the case of the empirical method.

The empirically found relationship may be used to send the disturbance variable when passing through velocity ramps during the later operation.

A process especially suitable for determining the register error in conjunction with a mark that is also especially suitable for the present invention, with which the register error can be determined, among other things, is described in the applicant's German Patent Application No. 196 39 014.1, whose disclosure is herewith referred to for the purposes of the present invention.

In an advantageous variant, the control behavior of at least the register controller for the second cylinder is changed specifically when a change that affects the circumferential register is made in a production condition. The change in the control behavior is brought about by making a specific change in at least one controller parameter. Changes in production conditions which induce a change according to the present invention in the control behavior are changes whose effect on the circumferential register or on the registry is foreseeable and reproducible. These include especially a change in the web length between two adjacent print mechanisms and optionally also to the sensors picking up the register as a consequence of a transformation of print positions and/or a change in the velocity of the web, especially during phases of acceleration and deceleration and/or a change in the paper grade as a consequence of a roll change and/or a change in the ink and moisture supply.

The preferred response to one or more changes in production conditions consists of an adapted change in the control behavior of the controller, namely, a controlled adaptation of at least one controller parameter, optionally of all or at least all essential controller parameters. The setting of the controller is adapted to the changed situation in real time or in an anticipating manner, preferably partly in real time and partly in an anticipating manner. As a real time variable, the formation of the controller parameter preferably includes the circumferential velocity or the velocity of the cylinders to be coordinated in good register. However, it is also possible to use, instead, the circumferential velocity of one of the other cylinders, which are to be coordinated with the second cylinder in good register, e.g., that of a reference cylinder.

In particular, changed web paths and web lengths that have changed as a result of such a change are taken into account in an anticipating manner by reading in parameter basic values at the time of the change in production.

In a device according to the present invention for coordination in good register, a control member is provided at least for the second cylinder to be coordinated in good register with the first cylinder, wherein the said control member forms a correction variable for compensating a register deviation of the second cylinder from the first cylinder, which register deviation is typical of the disturbance variable, from a disturbance variable, especially the circumferential velocity of the cylinder to be coordinated or of one of the other cylinders printing on the same side of the web.

The control member preferably has a memory, in which the disturbance variable-dependent curve of the register deviation of the second cylinder from the first cylinder is permanently stored or is read in for the particular case of printing by a higher press control or is selected from a plurality of permanently stored curves.

In an advantageous variant of the device, a register controller for the second cylinder to be coordinated with the first cylinder has a preferably digital signal processor, with a separate memory, in which the parameter basic values for the controller parameters of this controller are stored or into which the particular valid parameter basic values can be written. If a read-only memory is used, the circuit or the signal processor of the controller needs only be told which of these stored basic values shall apply to the current case of operation for the particular controller parameter. In one exemplary embodiment, the controller itself has both a RAM and a ROM and it receives the information from a higher control via a control signal only on which value or data set stored in the ROM of the controller it shall take over into its RAM and use it for the time being. However, the current set of values for the controller parameters may also be loaded directly into a RAM of the controller from the higher control.

In another advantageous embodiment of the present invention, a partial control system including a third cylinder is uncoupled from a partial control system including the second cylinder in terms of the circumferential register. The third cylinder prints on the same side of the web as do the first and second cylinders and it follows the second cylinder when viewed in the direction of travel of the web.

In a multicolor printing press, on which the present invention is preferably based, the first cylinder prints the reference color, and the second and third cylinders are coordinated with the first cylinder in good register. Changes in the cylinder position of the preceding cylinder or cylinders are passed on by uncoupling members in the register controller to the drive controller of the third cylinder as a change in the cylinder position such that the effect on the web tension is compensated by a register correction performed at the second cylinder or at the first and second cylinders.

The features disclosed above can be used not only for regulating or controlling the cylinders that are to be coordinated with a cylinder printing the reference color in good register. The cylinder printing the reference color itself may be regulated and/or controlled in the same way. This is advantageous for printing in good register, e.g., if there is a common component in the setting variables of the register controllers of all the printing inks following the reference color.

The described control and optionally regulation of the circumferential register may advantageously also be used for controlling and optionally regulating the crop mark, i.e., the register controllers of the cylinders can also be adapted in a controlled manner with respect to the crop mark. The crop mark may be taken into account in the course of the sending of the disturbance variable, advantageously with, but also without controlled adaptation.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
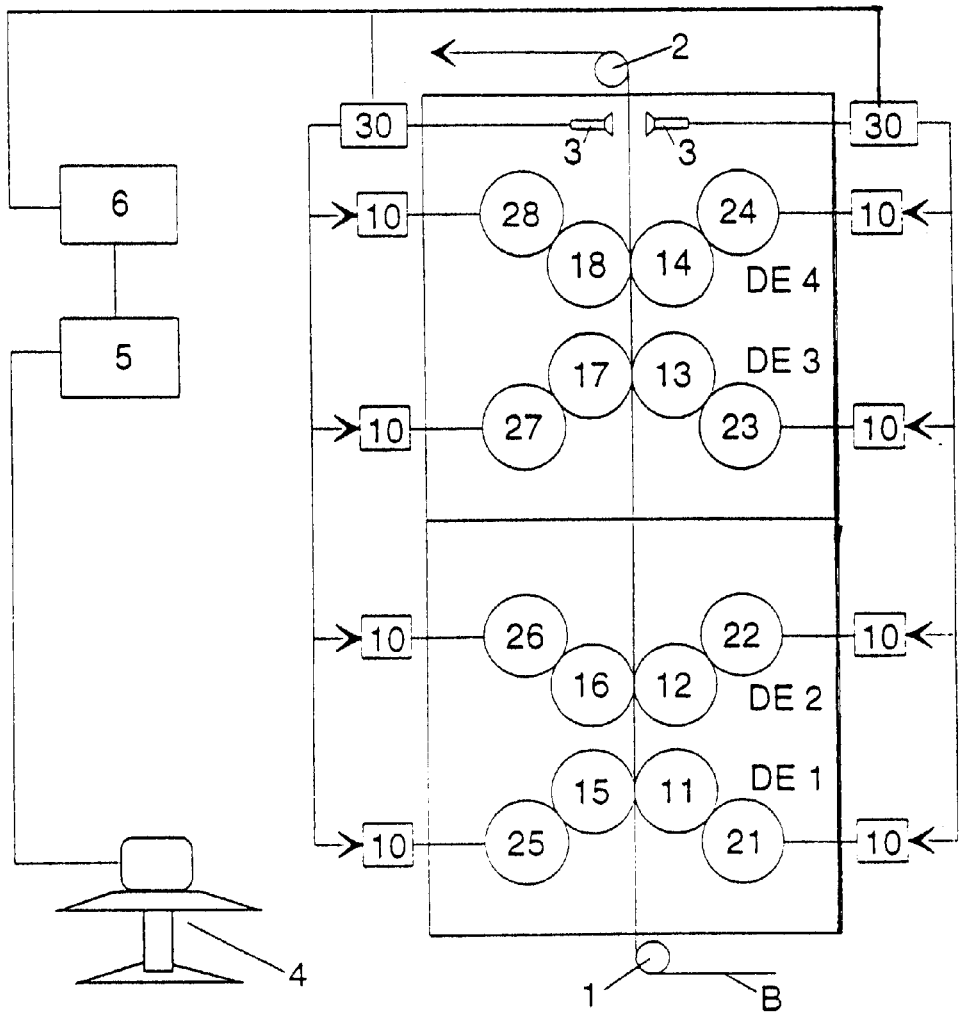
FIG. 1 is a view of a printing tower for four-color printing.

Referring to the drawings, FIG. 1 shows an 8-cylinder tower of a web-fed rotary printing press for newspaper offset printing. The printing tower is formed by four printing units DE1 through DE4, which are arranged among each other in two H bridges in the tower. Each of the printing units comprises two rubber blanket cylinders, which form a printing gap. A web B runs through the printing gaps. The blanket cylinders are designated continuously by 11 to 14 and from 15 to 8 beginning from the first printing unit DEI to the last printing unit D4 of the printing tower. One of plate cylinders 21 through 28, is associated with each of the rubber blanket cylinders 11 through 18. Inking and damping systems arranged downstream of the plate cylinders 21 through 28 are not shown for clarity's sake.

The web B is unwound from a paper roller of a roll changer. The web B then runs over guide rollers and a draw roller 1 into the printing tower. The draw roller 1 is not coupled on the drive side with the printing units DE1 through DE4 arranged downstream. The web is printed on in four colors on both sides in the printing tower. Since the present invention is not limited to the rubber/rubber production shown in FIG. 1, but it may also be used in satellite printing mechanisms, the rubber blanket cylinders 11 through 18 will hereinafter be unspecifically called printing cylinders because of their function of printing on the web. The first cylinders 11 and 15 print on the web in the first printing unit DE1 on both sides with the first color, which is preferably the color used for reference. The registry during the printing of the second color by the second cylinders 12 and 16 in the second printing unit DE2 as well as of the third and fourth colors is always measured and corrected with reference to the first color.

Register marks, which are picked up by means of a pair of sensors 3 arranged behind the fourth printing unit DE4, preferably a CCD camera pair 3, are also printed on the web by each of the printing cylinders 11 through 18.

An additional web draw roller 2, which is likewise not coupled with the printing units on the drive side, is arranged behind the fourth printing unit DE4. The web B is tensioned between the two draw rollers 1 and 2 directly at the inlet and at the outlet before the first printing unit DE1 and behind the fourth printing unit DE4, i.e., the first and last print positions for the colors to be printed over each other.

The arrangement of the sensor or sensors 3 is advantageous for the rapidity of the color register regulation and optionally the color register control, especially during non-stationary processes. It is important precisely during such phases to act in time, so that the color register or color registers will not run out of the tolerance range. To minimize the time between the development of the error and its elimination, i.e., the error run time, the printing units DE1 through DE4 should initially be located as close to one another as possible. It would be optimal for minimizing the error run time to arrange a sensor 3 behind each print position. However, it has proved to be sufficient and advantageous from the viewpoint of costs to provide only one sensor 3 per web side and to place this sensor 3 as close as possible behind the last print position, which is to be coordinated in good or accurate register with the reference color. The print position for printing the reference color should, on the other hand, be the one located farthest away from the sensor 3.

To increase the flexibility of the presses with respect to changing productions, it is possible to select the reference color depending on the present production. In the case of free selectability of the reference color, the printing site of the reference color is reported to an evaluating electronic unit at the sensor 3 or to the register controller 30, so that the coordination of the printing cylinders in good and accurate register can be correspondingly carried out.

The coordination of the printing cylinders 11 through 14 printing on one side of the web B in good register is performed by means of register controllers 30. The register controllers associated with each of the printing cylinders 11 through 14 in the shown exemplary embodiment, are physically integrated in a single register controller 30. The register deviations recorded by the sensor 3 associated with the particular side of the web are sent to an input of the controller 30. The register controller 30 is connected via another input to a bus of a higher control. In the exemplary embodiment shown, the higher control comprises a control station 4, section computers 5 and service interfaces 6 that can be accessed via modems. The software for the drive control of the motors 10 is provided by means of the higher control. The register control arrangement for the cylinders 15 through 18 printing on the other side of the web B are mirror images of the register control arrangement for the cylinders 11 through 14.

The time elapsing between the detection of an error and the sending of the corresponding setting variable should be as short as possible. A register controller 30 for a motor of one of the cylinders 11 through 18 is set adapted, among other things, to the error run time. A controller parametrization may therefore also vary during the operation of the press as a function of error run times, which also change, especially in the case of changes in the velocity of the web or of a change in the distance between the site of development of the error and the sensor 3 during changing productions. The dynamics of the partial control system, e.g., especially the free web length between the preceding print position and the print position being considered in the partial control system, may also affect the parametrization.

Finally, the transmission of the setting variable of the register controller 30 should take place as rapidly as possible, and the final control element itself should be able to follow the dynamics of the setting variables sent by the register controller 30.

Figure 2:
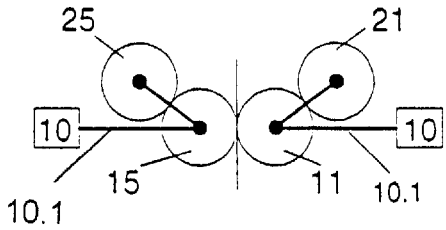
FIG. 2 is a view of a first drive for each of the printing units of the printing tower according to FIG. 1.
Figure 3:
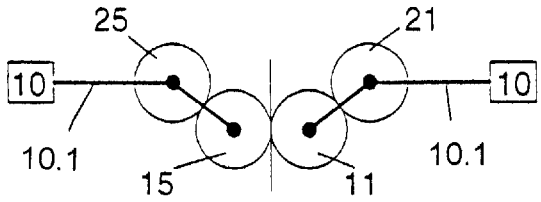
FIG. 3 is a view of a second drive for each of the printing units of the printing tower according to FIG. 1.
Figure 4:
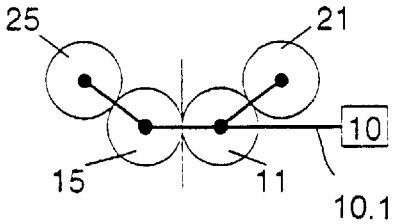
FIG. 4 is a view of a third drive for each of the printing units of the printing tower according to FIG. 1.

FIGS. 2 through 4 show alternative drive designs for the individually driven printing units DE1 through DE4.

In the drive shown in FIG. 2 for the printing units, the cylinders forming the printing gap, e.g., the cylinders 11 and 15, arc driven by a motor 10 via a transmission 10.1, preferably a toothed belt. The cylinders 11 and 15, which are thus driven directly, are mechanically coupled with their downstream plate cylinders 21 and 25, so that they drive these plate cylinders arranged downstream via gears, not shown. There is no positive coupling between the cylinders 11 and 15 forming the printing gap, so that we can speak of an uncoupling of the drive at the web. The angular position of the directly driven cylinders 11 and 15 relative to additional cylinders printing on the same side of the web is controlled in order to print with these additional cylinders in good and accurate register.

Instead of the cylinders 11 and 15 which form the printing gap, the plate cylinders 21 and 25 arranged after them are driven directly, again preferably via toothed belts, in the drive design shown in FIG. 3. The cylinders 11 and 15 are driven together beginning from the plate cylinders 21 and 25 via gear trains, not shown. The two drive designs according to FIGS. 2 and 3 are otherwise the same.

FIG. 4 shows another drive design, in which both cylinders 11 and 15 which form the printing gap, and the respective plate cylinders 21 and 25 arranged after them, are mechanically coupled with one another and are driven by a common motor 10. The drive from the motor 10 again takes place via a transmission, preferably a toothed belt, to one of the two cylinders 11 and 15 forming the printing gap. The other driven cylinders, namely the counterpressure cylinder and the plate cylinders, are driven via a gear train from the this one cylinder.

Figure 5A:
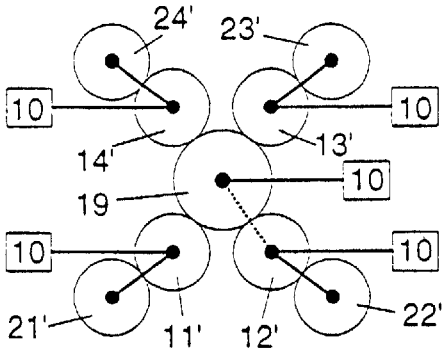
FIG. 5*a* is a view of a drive for a satellite printing mechanism.
Figure 5B:
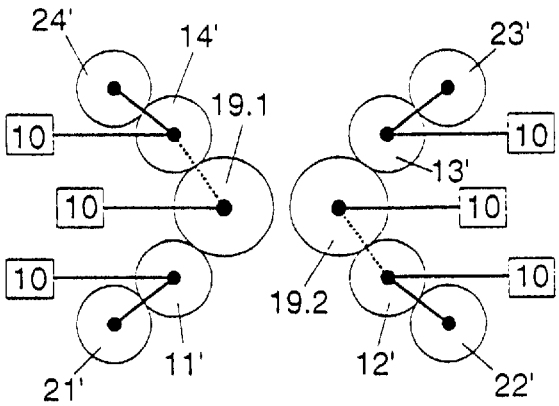
FIG. 5*b* is a view of a drive for a 10-cylinder printing mechanism.

While the drive designs shown in FIGS. 2 through 4 pertain to rubber/rubber productions, FIGS. 5*a* and 5*b* show that the design of the individually driven cylinders printing on the web can also be used in the same manner in satellite printing mechanisms. A central steel cylinder 19 is driven in FIG. 5*a* by a motor 10 via a transmission, preferably a toothed belt. The cylinders 11' through 14' form printing gaps or print positions with this central cylinder 19 and arc each driven by a motor via a transmission, preferably a toothed belt. The plate cylinders 21' through 24' arranged downstream of cylinders 11' through 14' are driven by these cylinders 11' through 14' in a positive-locking manner. The broken line in FIG. 5*a* indicates that the central cylinder 19 could also be coupled mechanically with one of the cylinders 11' through 14', i.e., it could be in a positive-locking connection with one of these cylinders, so that the separate motor for this central cylinder 19 would be eliminated in this case. The angular positions of the cylinders 11' through 14' printing on the same side of a web are also controlled in good or proper register in relation to one another in the satellite printing mechanism according to FIG. 5*a*. A superimposition of the controls for the central cylinder 19 with each of the cylinders 11 through 14 may also be profitably used in terms of minimizing deviations from the ideal circumferential register. FIG. 5*b* shows a corresponding solution based on the example of a 10-cylinder printing mechanism with two central cylinders 19.1 and 19.2.

Inking and damping systems arranged downstream of the plate cylinders 21 through 24 and 25 through 28 as well as 21' and 24' may be mechanically coupled with the plate cylinders to form a common drive, i.e., by positive locking. However, the inking and damping systems may also be driven by separate motors. Units to be driven on the drive side, which have approximately equal moments of inertia, are advantageous, because the drive requirements of the printing press can thus be met with a few motor sizes and preferably with a single motor size.

Figure 6:
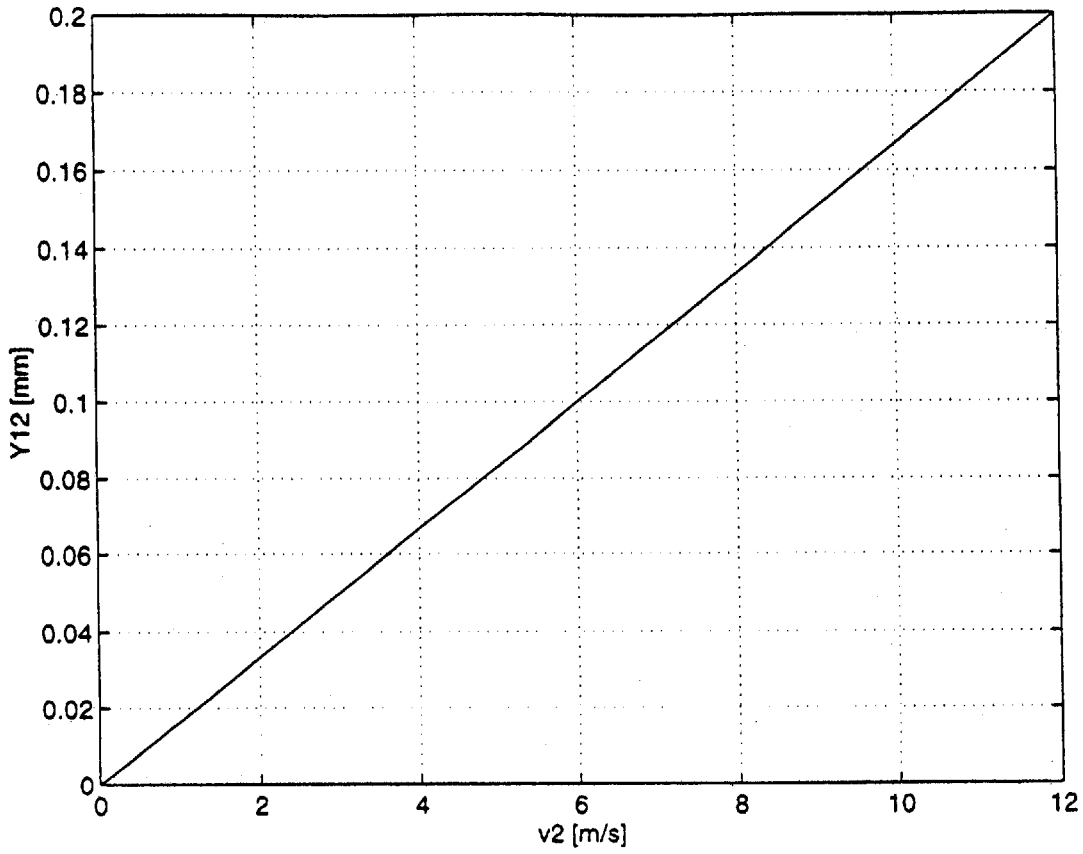
FIG. 6 is a graph of a circumferential register characteristic for one printing ink.

FIG. 6 shows a characteristic obtained by measurement and interpretation for the register deviation $Y_{12}$ of the second cylinder 12 from the first cylinder 11. The first cylinder is the reference cylinder. The register deviation $Y_{12}$ is plotted as a function of the circumferential velocity $v_2$ of the second cylinder 12. The characteristic in FIG. 6 is reproducible.

Such characteristics can be determined and stored in a data bank of the press especially for different types of presses, different paper grades and different press configurations, i.e., for different path lengths between adjacent print positions. The correct data set can be found based on these data sets stored in the data bank after the corresponding selection of the type of the press, of the paper grade currently used, and of the press configuration currently set. A compensating register correction is thus determined from the current circumferential velocity $v_2$ occurring during the production based on the relationship shown in FIG. 6.

A characteristic similar to that shown in FIG. 6 is determined for each of printing unit, i.e. the second cylinder 12 and 16, and correspondingly for the other cylinders, so that they are each coordinated in good and proper register. The characteristics are different in the different printing applications e.g., because of different paper grades, which display different web tensions at equal circumferential velocity of the cylinder. In particular, different web paths cause a change in the behavior of the web during a change of production. The correct curve is selected from the data bank for the motor controllers of the cylinders of the printing units that follow the first printing unit DE1 used as the reference. Depending on the current circumferential velocity of the cylinder, a correction variable i.e., the component of a disturbance variable to be sent, is formed based on the characteristic selected and is sent to the command variable of the motor controller 8.

A disturbance variable is optionally also sent in the case of the cylinders 11 and 15 of the first printing unit DE1. The sending of such a disturbance variable in an application having the first cylinders 11 and 15 is beneficial especially for crop mark control.

If the reference cylinder is freely selectable to increase the flexibility, characteristics $Y_{kl}$ ($v_l$) are measured and kept ready in a data bank of the press. The subscript $\underline{k}$ in $Y_{kl}$ designates the reference cylinder and the subscript $\underline{1}$ the respective cylinder following it, which is to be properly registered. With the first cylinder 11 as the reference cylinder in the exemplary embodiment shown, this means that k=1 and 1=2, 3, 4.

Figure 7:
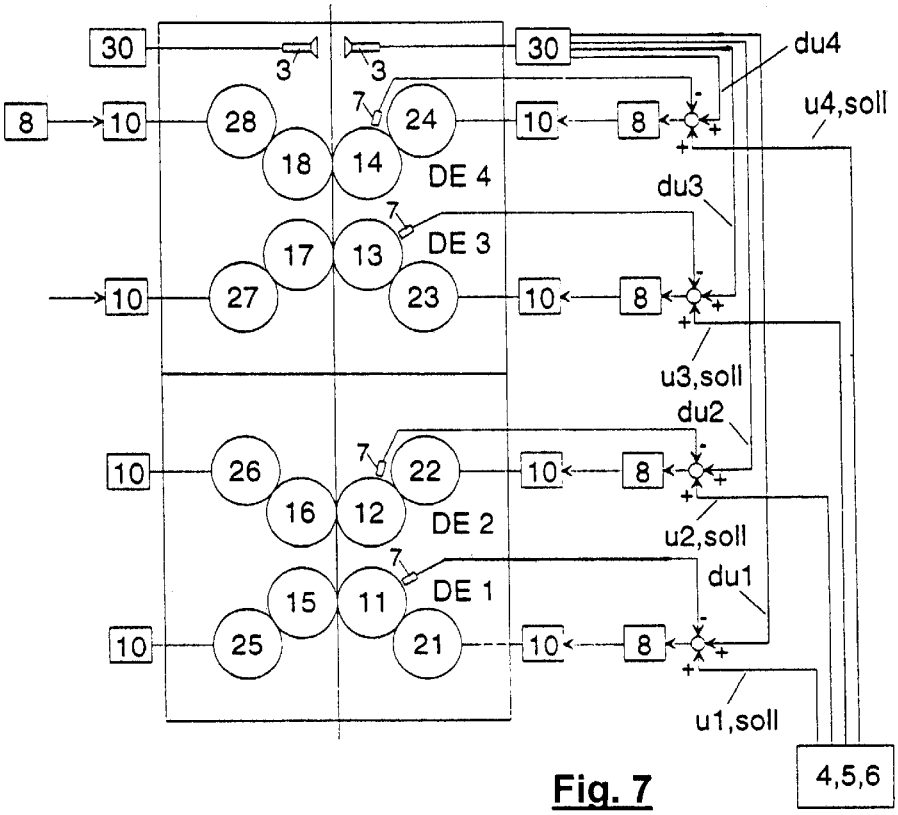
FIG. 7 is a view of a control circuit for controlling the position of a cylinder of the printing tower according to FIG. 1, which prints on a web.

FIG. 7 shows a controller arrangement for the cylinders 11 through 14 printing on the right side of the web and, in a preferred embodiment, also for the cylinders 15 through 18 printing on the left side of the web. However, only the control on the right side of the web will be described below. This description will analogously also apply to the control on the left side of the web.

The register marks printed on the web are picked up by the sensor 3 and evaluated in the measuring head of the sensor 3. The register deviations $Y_{l,i}$ of the cylinders 12, 13 and 14 determined from the reference cylinder 11 are sent from the output of the sensor 3 to an input of the register controller 30. The register controller 30 is divided internally into one register controller each for each of the cylinders 11 through 14. From these register deviations, each of the individual controllers of the register controller 30 forms a setting variable for its control system, which contains the cylinder in question, its motor 10 and motor controller 8, the web, and the sensor system.

The angular positions of the cylinders 11 through 14 are controlled by a motor controller 8 each. An individual desired angular position is formed for this purpose for each of the cylinders 11 through 14. The angular position $\phi$ is represented by a length u [mm] unwound from the circumference of the cylinder. The designed or desired angular position is composed of a component $u_{i.Soll}$, which is preset by the higher control 4, 5, 6, and a correction $du_i$. The desired angular position is now compared with the actual angular position $u_{i.1st}$ picked up by a sensor 7. The actual values are preferably picked up at the torque-free ends of the cylinders 11 through 14. A difference is determined from the comparison. The difference is converted by the motor controller 8 into a setting variable for its motor 10.

Figure 8:
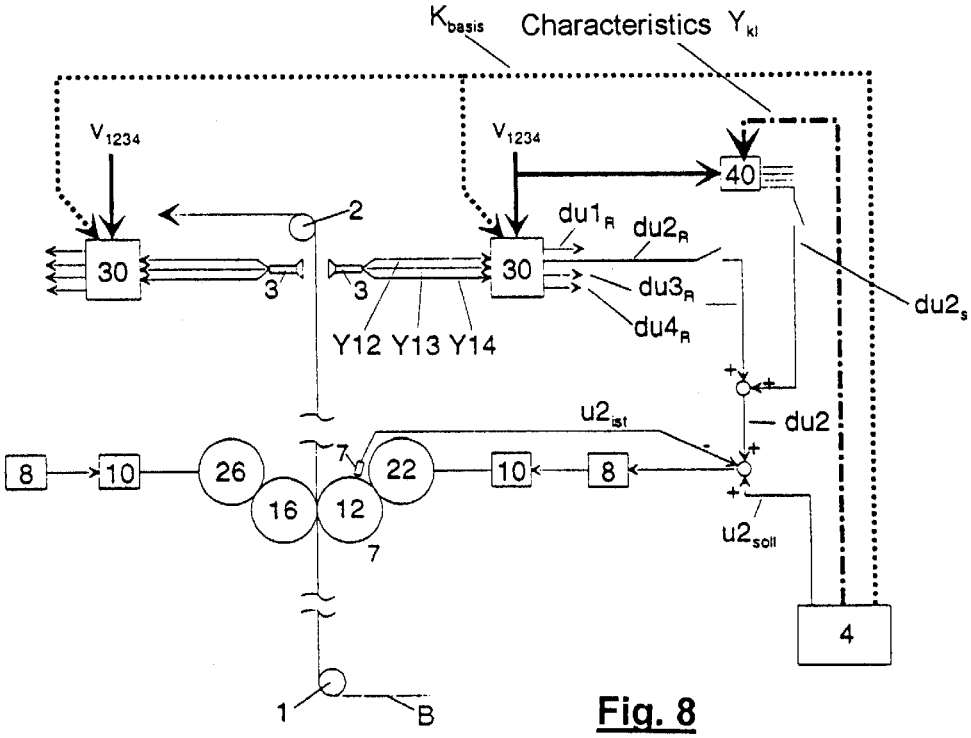
FIG. 8 is a view of a register controller for the control circuit according to FIG. 7.

The control for the second cylinder 12 is shown as an example in greater detail in FIG. 8. The register control of the other cylinders is analogous. The input variables for the register controller 30 and the individual register controllers forming this controller 30 (FIG. 15) are the register deviations $y_{kl}=(Y_{12}, Y_{13}, Y_{14})$ picked up and determined by the sensor 3. Thus, $Y_{12}$ represents the register deviation of the second cylinder 12 from the first cylinder 11. The other register deviations can be described analogously. Furthermore, the measured circumferential velocities $v_1$ through $v_4$ ($=v_{1234}$) of the cylinders 11 through 14 are sent to the register controller 30. It would also be sufficient to use the circumferential velocity of only one of the cylinders 11 through 14 to be registered, preferably that of the reference cylinder, as the circumferential velocity of the others.

Via a third input, the register controller 30 is connected to the higher control, which is designated simply by 4 in FIG. 8. Parameter basic values $k_{Basis}=(k_{P\ Basis}, k_{D\ Basis}, k_{I\ Basis}, k_{f\ Basis})$ sent by the higher control 4 and optionally coefficients $a_P$, $a_I$, $a_D$ for the second cylinder 12 are present at the third input. The first three basic values are intended for the controller, and the fourth for a filter. Parameter basic values $k_{Basis}$ are correspondingly also sent for the third cylinder 13 and the fourth cylinder 14 and optionally also for the first cylinder 11. The register controller 30 forms its setting variable $du_{2.R}$ from these input variables, i.e., the register deviation $Y_{12}$, the circumferential velocity $v_2$, and the parameter basic values. This output variable or setting variable is sent to the input of the motor controller 8 together with its command variable $u_{2.Soll}$ from the control 4 and the actual angular position $u_{2.1st}$ in the form of the difference $u_{2.Soll}+du_2-u_{2.1st}$. A PID controller known from EP 0 644 048 may be used, e.g., as the motor controller 8.

The register controller 30 of the exemplary embodiment is also designed as a controller with PID elements, with the controller parameters $k_P$, $k_I$, $k_D$. Each of these controller parameters is formed by the register controller 30 as a function of the corresponding parameter basic value and the circumferential velocity of the cylinder, i.e., as a function of the parameter basic values and circumferential velocities, which are individual for each cylinder. Thus, the following can be written individually for each of the cylinders 11 through 14:

$$k_P=f(k_{P\ Basis}, v)$$
$$k_I=f(k_{I\ Basis}, v) \quad (1)$$
$$k_D=f(k_{D\ Basis}, v)$$

As will be described later, one coefficient a each may be added per controller parameter $\underline{k}$ in the exemplary embodiment. Each of the controller parameters is thus formed as a function of the corresponding parameter basic value, a representative velocity, which is individual for the individual cylinders or is the same for all cylinders, and optionally the latter coefficient.

The parameter basic values $k_{Basis}$ are determined in the exemplary embodiment only as a function of the dynamics of the partial control systems, i.e., exclusively or at least mainly by the web paths to the preceding cylinder and to the sensor 3. The controller parameters of the exemplary embodiment are proportional to the product of the parameter basic value and the circumferential velocity, i.e., $$k_P = k_{P\ Basis} * v$$
$$k_I = k_{I\ Basis} * v \quad (2)$$
$$k_D = k_{D\ Basis} * v$$

The above-mentioned relationships according to (1) and (2) between the controller parameters and the variables determining same are valid for each of the cylinders to be coordinated in good register with their individual parameter basic values. When forming the equations of the I and D components in an algorithm for a preferably discrete controller, the scanning time T included in the weighting is preferably kept constant, at least in some ranges, i.e., within preset velocity ranges.

The parameter basic values $K_{Basis}$ and the coefficients a, which are also used optionally for the controller parameters, are preset for the register controller 30 by the press control in an anticipating manner at the time of a product change and the associated transformation of the print position. In the exemplary embodiment, the parameter basic values take into account only the length of the web to the printing cylinder that is the preceding cylinder in printing. A corresponding setting at the press control station 4 is converted by the press control into the parameter basic values and passed on to the register controller 30. These parameter basic values are valid until a new transformation of the print position is performed. The circumferential velocities $v_1$ through $v_4$ are measured and are used in real time by the register controllers 30 continuously to form its output variable $du_{i.R}$ within the framework of a suitable control algorithm, preferably a PID control. However, it is also possible to use a circumferential velocity measured for one of the cylinders 11 through 14 for all the cylinders to be coordinated in good register.

The circumferential velocity $v_2$, used as a disturbance variable, is additively sent by a control member 40 to the output variable $du_{2.R}$ of the register controller 30, which was formed by controlled adaptation. The sum $du_2$ formed from this is additively sent to the command variable $u_{2.Soll}$ of the press control 4, and the difference between the command variable thus formed and the actual position value $u_{2.1st}$ measured is the deviation for the motor controller 8.

An output variable $du_{2.S}$, used as a correction variable, is formed in the control member 40 as a function of the velocity $v_2$ of the second cylinder 12, which is preferably measured. Characteristics are stored for this purpose in a memory of the control member 40 for the connection between the register deviations and the cylinder velocities. To form the correction value or the sent disturbance variable $du_{2.S}$, the register deviation $Y_{12}$, which depends on the velocity $v_2$ of the second cylinder 12, is used, as is shown as an example in FIG. 6. The control member 40 calculates from this characteristic the correction variable $du_{2.S}$ used to compensate the register deviation $Y_{12}$, i.e., a scaling and/or a change in sign takes place as a conversion, depending on the definition of $Y_{12}$ and $du_{2.S}$. Only one characteristic is stored in the exemplary embodiment in the memory of the control member 40 for each of the register deviations $Y_{12}$ through $Y_{14}$, especially the characteristic according to FIG. 6 for the second cylinder 12, i.e., only the circumferential velocities of the cylinders are used as input variables for the control member 40 in this case. However, since the register deviations depend, in general, on other influential variables as well, especially the free web length to the preceding cylinder and to the sensor 3, the ink and damping agent feed as well as the grade of the paper, a representative, mean curve is stored for the corresponding register deviation if only one characteristic is used. However, sets of characteristics may also be stored in the memory of the control member 40 for each of the register deviations in an advantageous variant. The characteristic to be currently used is selected in this case by the control 4 via a line shown by dash-dotted line in FIG. 8. A single one of the velocities $v_1$ through $v_4$, especially that of the reference cylinder, may also be used similarly as a representative velocity instead of individual velocities to form the correction variables $du_{i.S}$. Instead of permanently storing the characteristic or characteristics in a memory of the control member and selecting the relevant characteristic therefrom for the particular case of printing, the characteristics may also be stored in a data bank of the press control and be sent to the memory of the control member via the $Y_{KL}$ bus at the beginning of the production.

During the stationary and nonstationary operation of the press, the correction variable $du_{2.S}$ may also be used alone to compensate systematic register errors and register deviations. This mode is indicated by an open switch at the output of the controller 30. The variable $du_2$ sent is identical in this case to the disturbance variable component $du_{2.S}$(= correction variable) of the control member 40. However, the sending of this correction variable is also optional, i.e., the variable $du_2$ sent may also be identical to the setting variable $du_{2.R}$ of the controller 30. This mode is also symbolized by an open switch. It is also possible for $du_{i.R}$ and $du_{i.S}$ to form together the variable $du_i$ sent, i.e., both symbolic switches are closed in this case.

Figure 15:
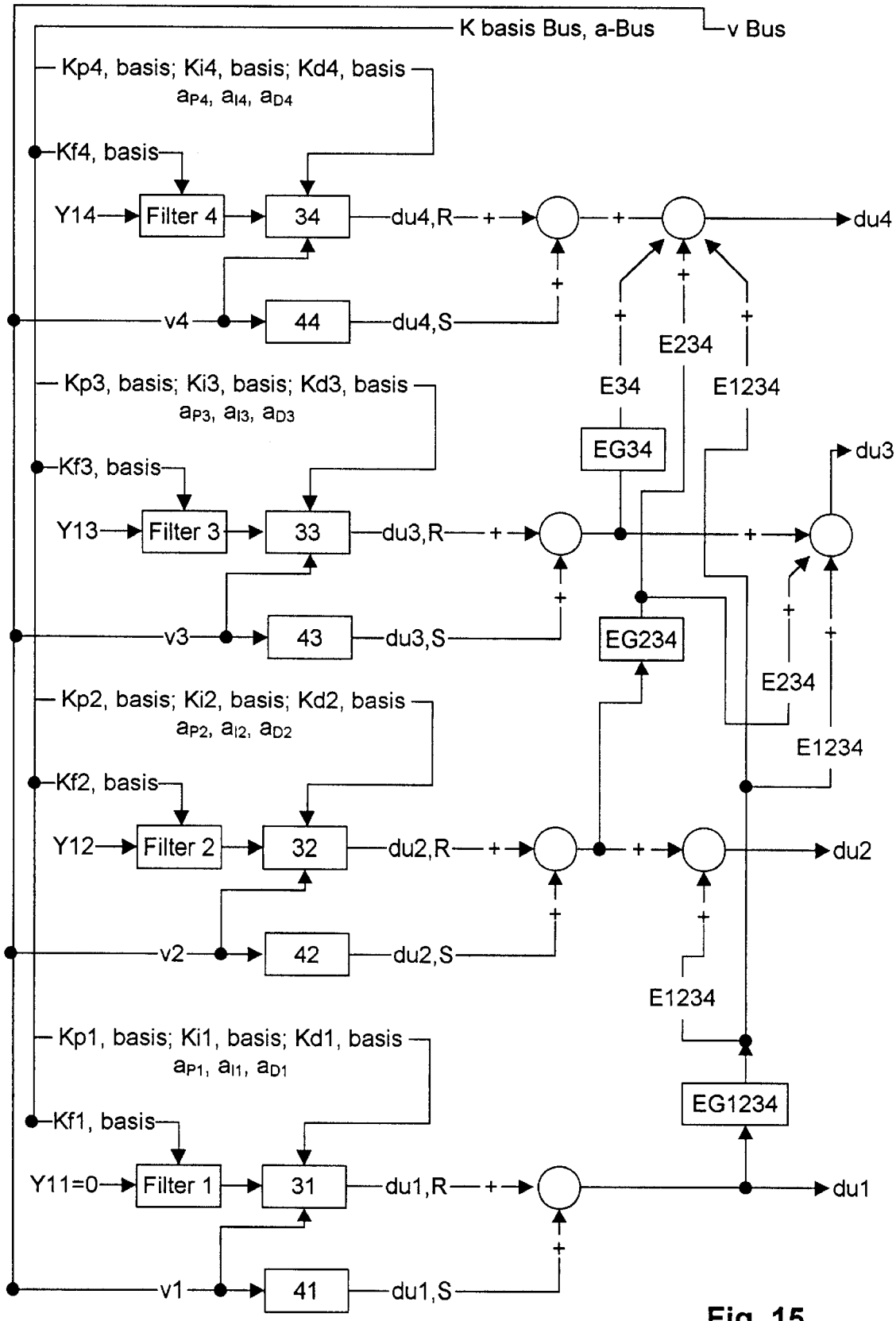
FIG. 15 is a view of a register controller for four cylinders.

As is shown in FIG. 8, the control member 40 may be provided as an independent control member in addition to the motor controller 8 and to the register controller 30. However, it may advantageously also be divided into individual control members for the individual cylinders 11 through 14 and be arranged directly before the motor controllers 8 in this division. A third possibility, namely, the implementation of the individual control members 41 through 44 forming the control member 40 in the register controller 30, is shown in FIG. 15.

Figure 9:
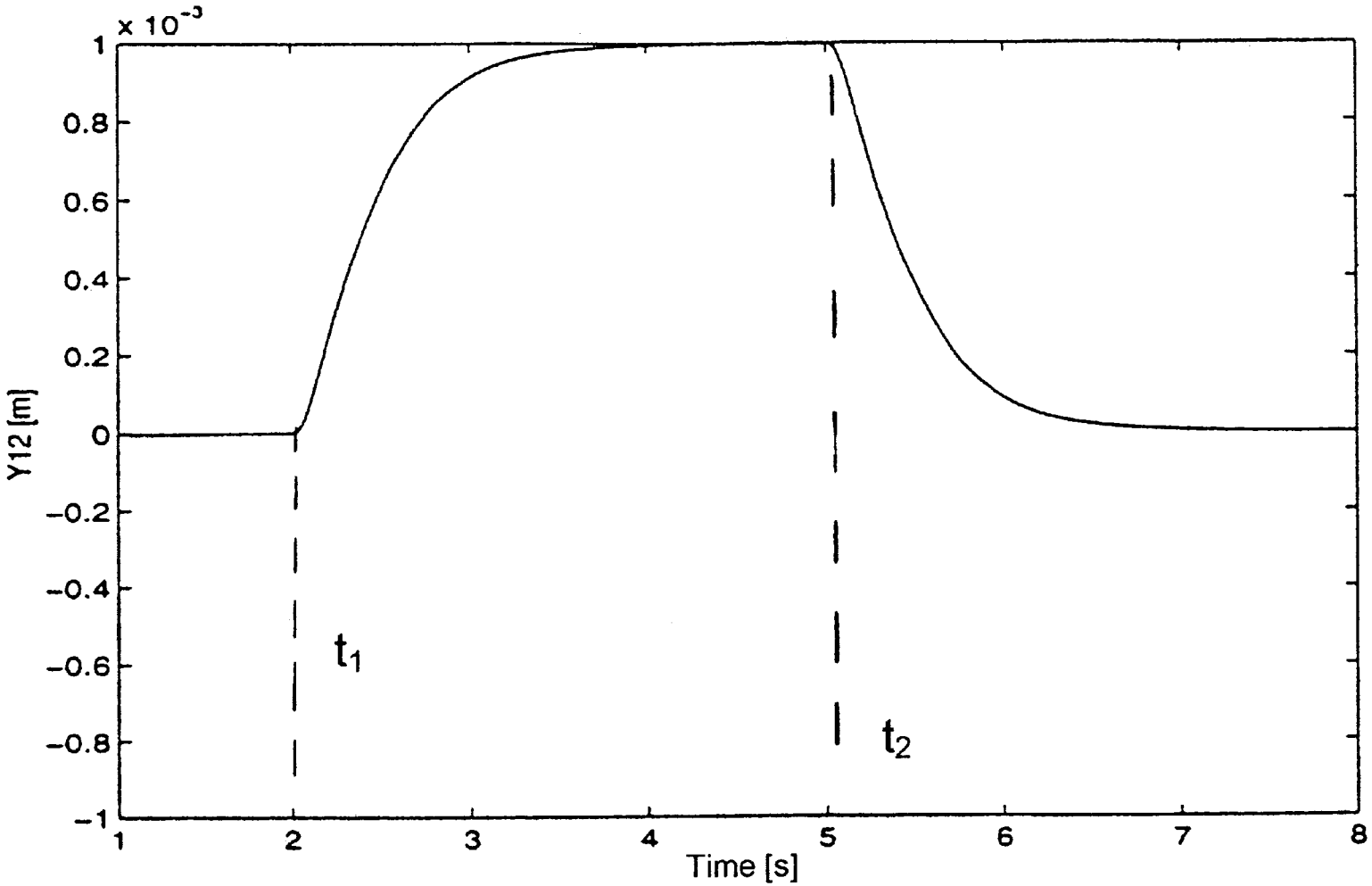
FIG. 9 is a graph of the curve of the register deviation at the time of the adjustment of the angular position of a cylinder of the second printing unit of the printing tower according to FIG. 1, which prints on the web.
Figure 10:
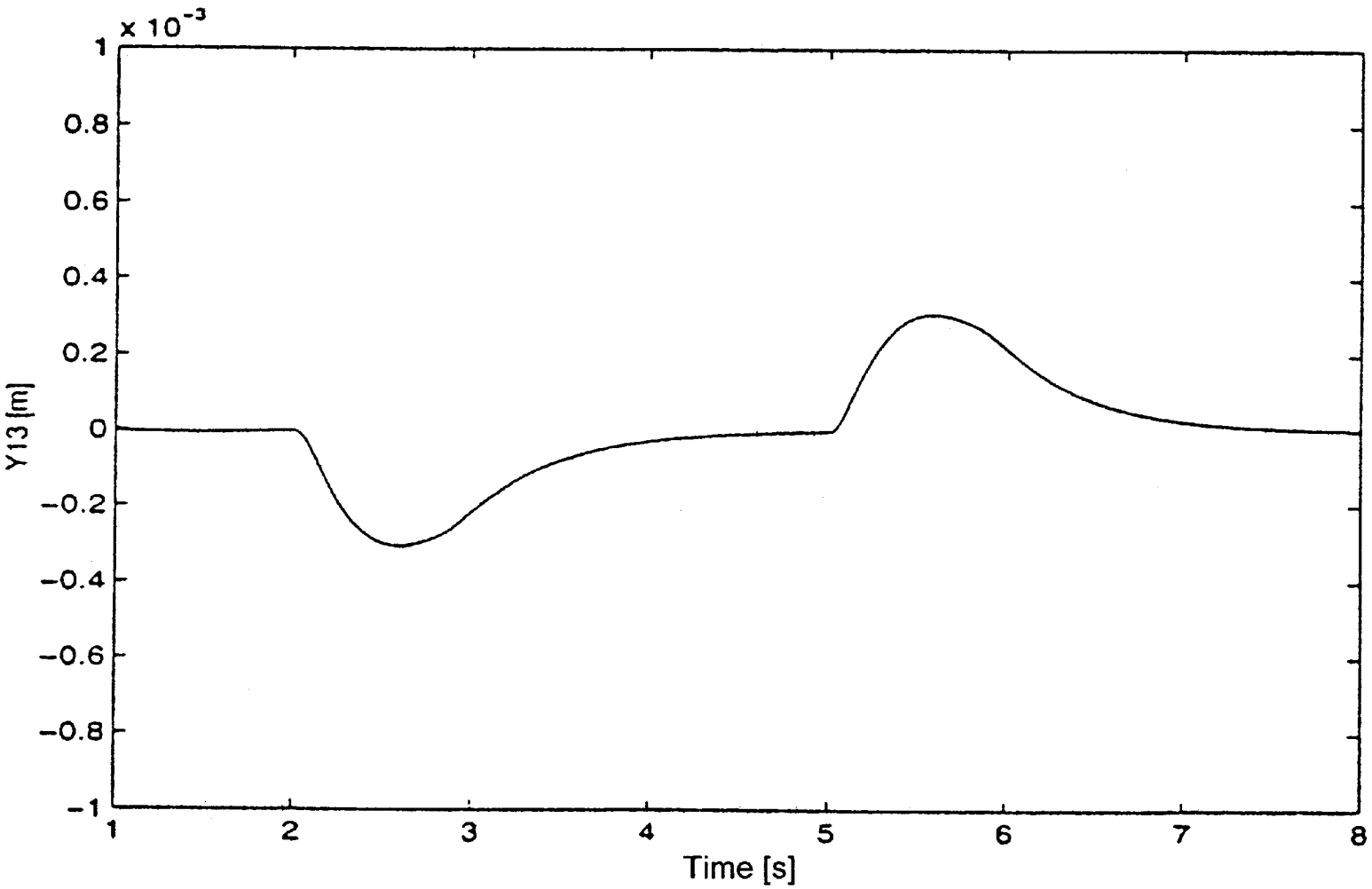
FIG. 10 is a graph of the curve of the register deviation of the printing ink applied in the third printing unit of the printing tower according to FIG. 1 as a consequence of the adjustment according to FIG. 9.
Figure 11:
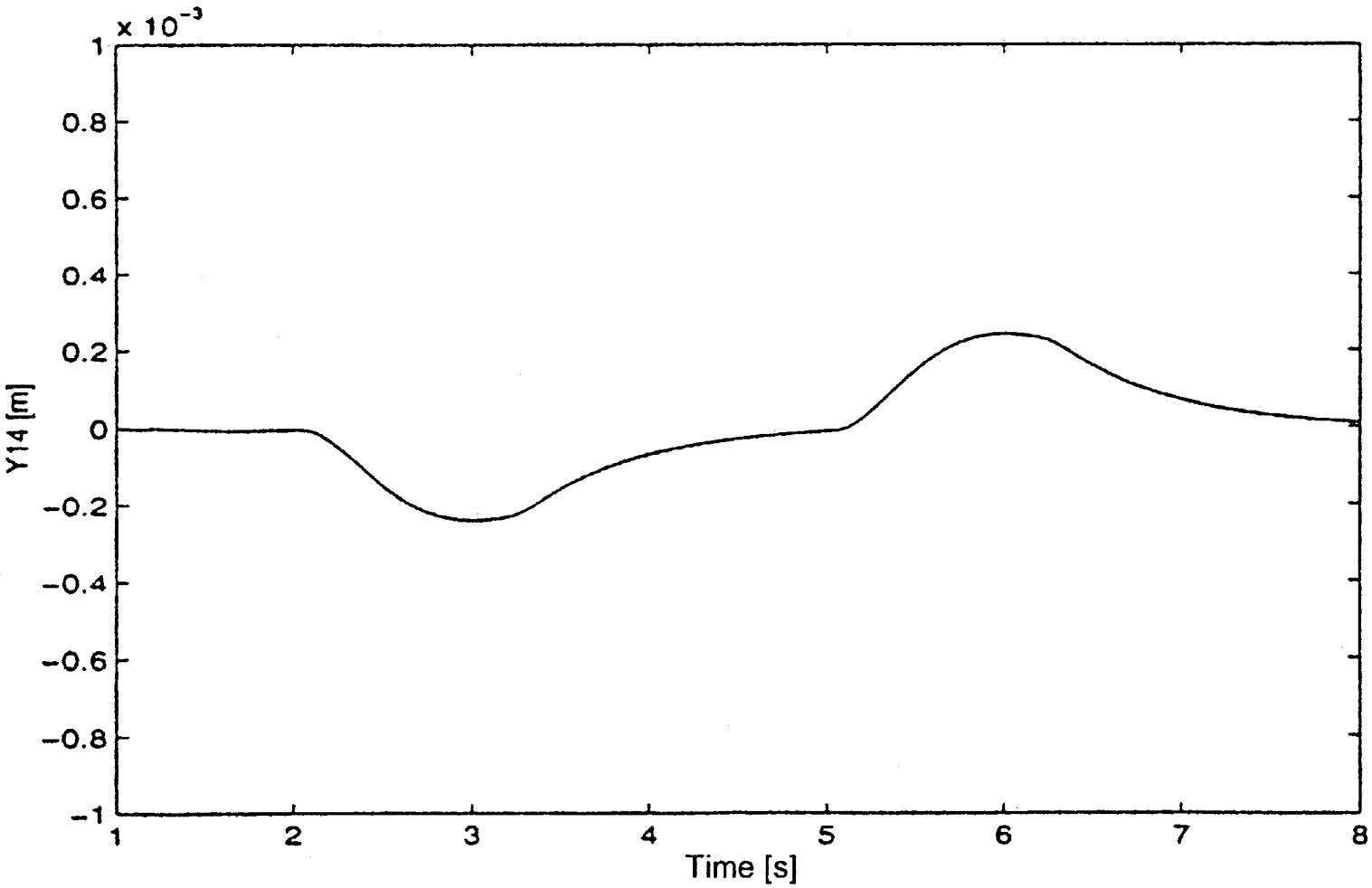
FIG. 11 is a graph of the curve of the register deviation of the printing ink applied in the fourth printing unit of the printing tower according to FIG. 1 as a consequence of the adjustment according to FIG. 9.

FIGS. 9 through 11 show the effect of a register adjustment performed at the second cylinder 12 on the registers of the downstream cylinders 13 and 14. FIG. 9 shows the deviation of the register of the second cylinder 12 from the first cylinder 11 as a function of the time for the case of a rectangular excitation $du_2$. The register of the second cylinder 12 was adjusted by 1 mm at a preset first time t1, and it was again reset at a preset second time t2. The adjustment of the second cylinder 12 is noticeable in the register of the next, third cylinder 13 at the above-mentioned first and second times only, i.e., at the transition points of FIG. 9, in the form of a first and second hump under and above the line for zero deviation. A similar behavior is also shown by the register of the fourth cylinder 14 according to FIG. 11. The components $du_3$ and $du_4$ in the command variables for their motor controllers 8 equal zero.

Figure 12:
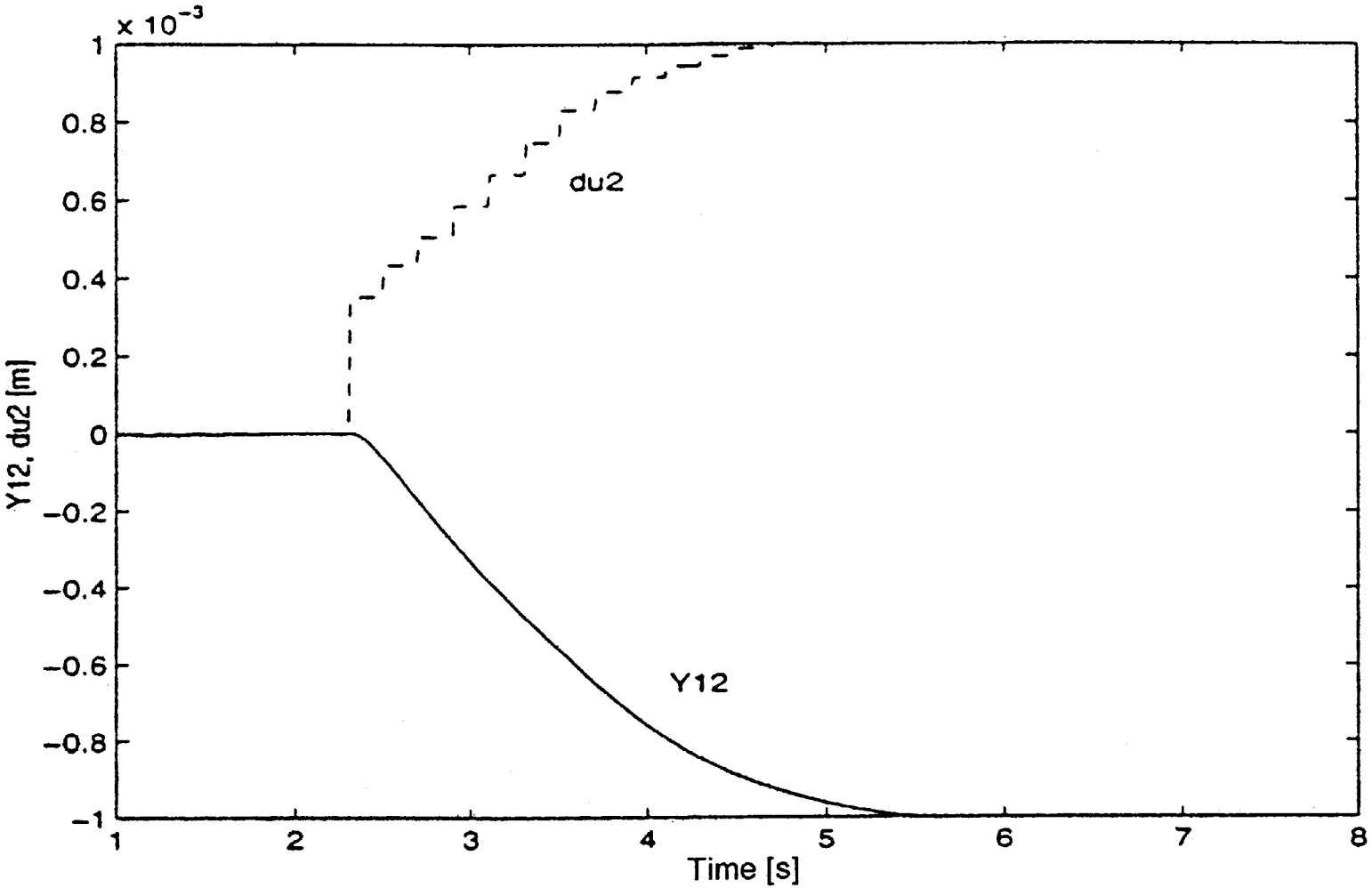
FIG. 12 is a graph of the curve of the register deviation corresponding to FIG. 9 together with the curve of the setting variable bringing about the adjustment of the second cylinder.

The change in the excitation $du_2$ is shown in FIG. 12 in addition to the curve of the register deviation $Y_{12}$ for another example of the register adjustment.

Figure 13:
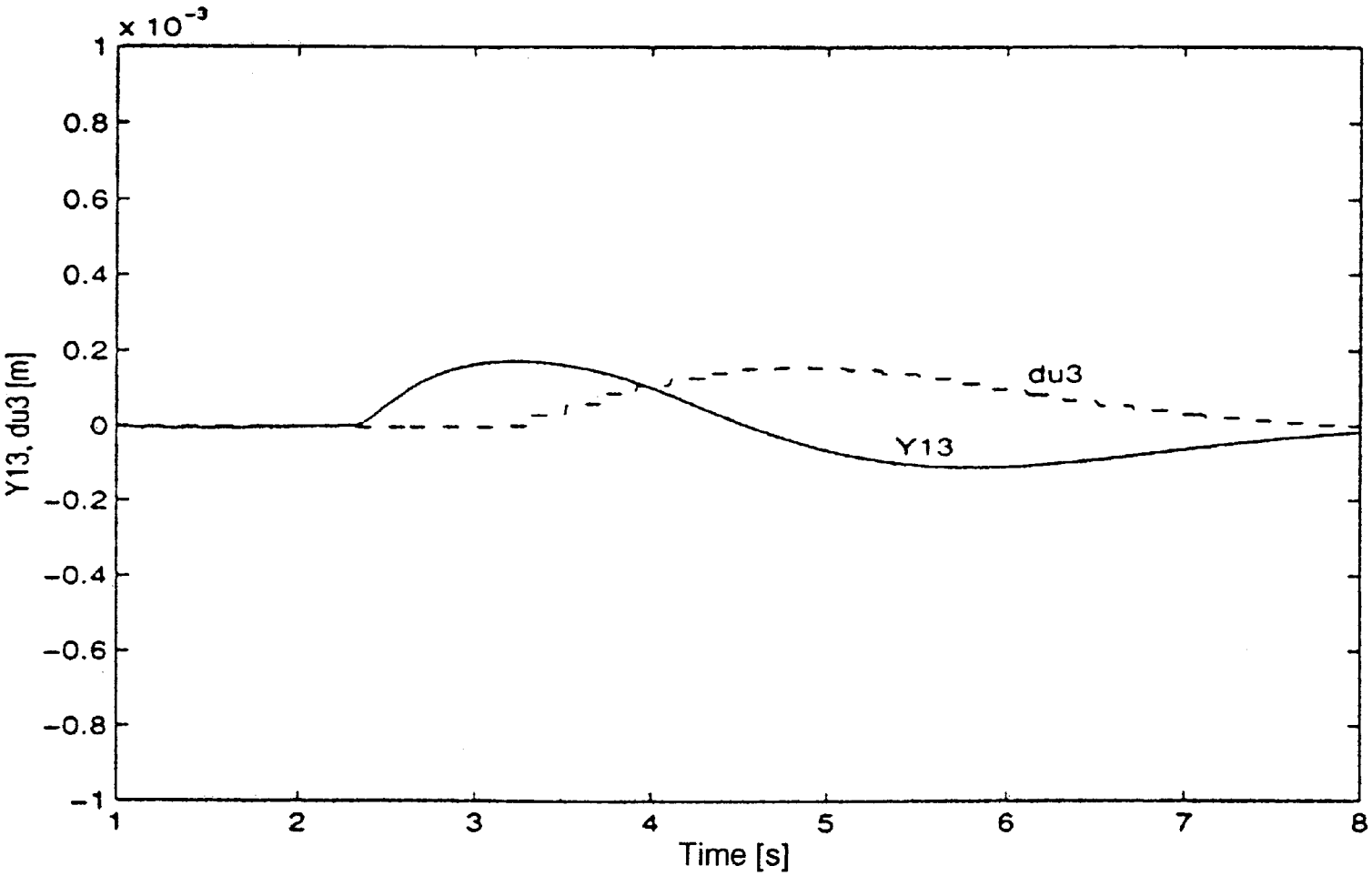
FIG. 13 is a graph of the effect of the adjustment according to FIG. 12 on the register of the color printed subsequently in the case in which the control system with the cylinder of the color printed subsequently is not uncoupled from the control system with the color printed previously.

FIG. 13 shows the curve of $du_3$ and the curve of the register deviation $Y_{13}$ for the third cylinder 13. The register adjustment according to FIG. 12 at the second cylinder 12 also brings about an adjustment of the circumferential register in the downstream cylinders 13 and 14, as is shown already in FIGS. 10 and 11. As soon as a register deviation $Y_{13}$ has been detected by the sensor 3, the motor of the third cylinder 13 is readjusted to eliminate the register deviation $Y_{13}$. The component $du_3$ of the command variable for the motor controller 8 of the third cylinder 13, which component corresponds to the readjustment, is shown in FIG. 13. As can be recognized from FIG. 13, this command variable will change by $du_3$ only with a certain time delay relative to the register deviation $Y_{13}$ that has occurred. The control systems for the two cylinders 12 and 13 are coupled. As is shown in FIG. 13, not only does the delayed change $du_3$ cause that the register deviation $Y_{13}$ can come into being undisturbed, but it also brings about a considerable overshooting of the register deviation $Y_{13}$ in the other direction after the reduction of $Y_{13}$. The overshooting even takes place at a time at which the register deviation $Y_{13}$ would return to the desired zero deviation without the change $du_3$. The overshooting is thus caused actually by $du_3$ in the first place.

Figure 14:
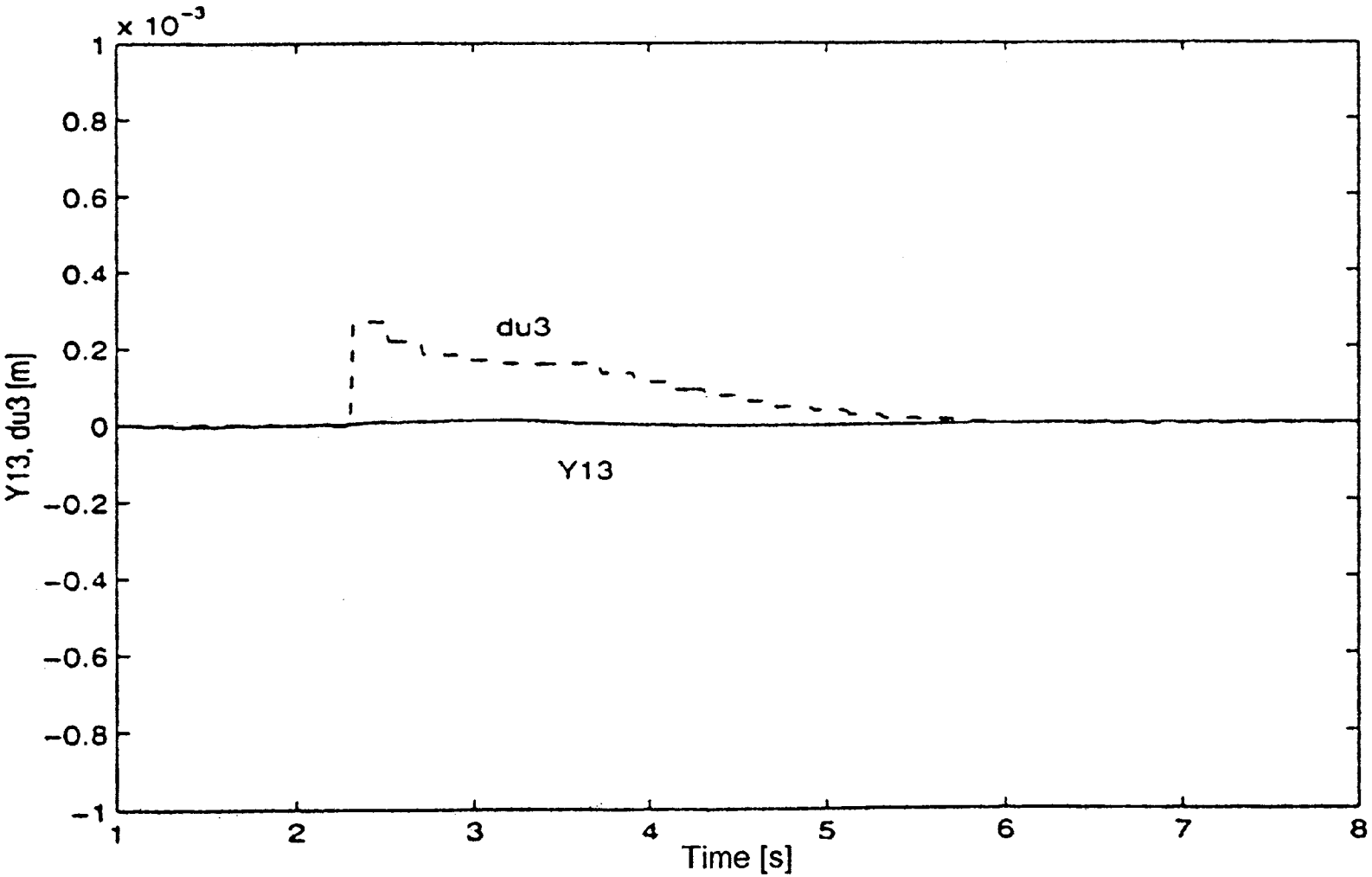
FIG. 14 is a graph of the effect of the adjustment according to FIG. 12 on the register of the color printed subsequently in the case in which the control system with the cylinder of the color printed subsequently is uncoupled from the control system with the color printed previously.

FIG. 14 shows the curve of the register deviation $Y_{13}$ of the third cylinder 13 for the case in which a control engineering uncoupling is performed or activated for the control systems of the second cylinder 12 and the third cylinder 13.

The favorable curve of the register deviation $Y_{13}$ of the third cylinder 13 shown in FIG. 14 relative to the first cylinder 11 is achieved by adding a certain component of the output of the register controller for the second cylinder 12 to the command variable of the motor controller 8 for the third cylinder 13. The effects resulting from the effect of the adjustment of the register of a preceding cylinder on the web tension are compensated by the summation in terms of a coordination in good register. The above-described summation into the command variable of the motor controller for the third cylinder 13 may be performed alone or in combination with the above-mentioned sending of the disturbance variable.

FIG. 15 shows an exemplary embodiment of the register controller 30, which is formed by integrating the control member within the controller 30 according to FIG. 8. Uncoupling members are provided as well.

The circumferential velocities $v_1$ through $v_4$ of the four cylinders 11 through 14 printing on the same side of the web and the parameter basic values for these cylinders are sent to the register controller designated by 30 as a whole on a first bus $\underline{v}$ and a second bus $k_{Basis}$, which together may also be integrated into a single bus. The coefficients $\underline{a}$, which are optionally also preset with the parameter basic values, are transmitted via the $K_{Basis}$ bus or a separate bus.

The register controller 30 has one main controller each for each of the cylinders 11 through 14. The respective main controllers are designated by 31 through 34. They are all PID controllers. Each of the main controllers 31 through 34 and of the filters 1 through 4 receives a set of parameter basic values $k_{Pi.Basis}$, $k_{Ii.Basis}$, $k_{Di.Basis}$ and $k_{fi.Basis}$, which are individual for their respective cylinders; cylinder-individual coefficients $a_{Pi}$, $a_{Ii}$, $a_{Di}$ are also sent to the main controllers. The register deviations $Y_{12}$ through $Y_{14}$ are sent to the main controllers 32 through 34 via a respective upstream filter, namely, filter 2, filter 3 and filter 4. At the beginning of a production, the parameter basic values are read for that production into a memory of each of the main controllers 31 through 34 once for the entire production. However, it is also possible to use a plurality of sets of parameter basic values that are specific of a production, e.g., a first set for a first velocity range and a second and optionally a third set for a second or even third velocity range of the cylinders. The parameter basic values in the exemplary embodiment shown, take into account only the length of the free web from the corresponding cylinder and the length of the web to the sensor 3. If one sensor 3 is provided for each of the cylinders 11 through 14, the parameter basic values do not need to take into account the corresponding web lengths to such individual sensors 3. Each of the main controllers 31 through 34 forms its controller parameters $k_P$, $k_I$, and $k_D$ from the parameter basic values and the measured circumferential velocity of the cylinders according to the following equations:

$$k_P=a_P+k_{P\ Basis}*v$$
$$k_I=a_I+k_{I\ Basis}*v \qquad (3)$$
$$k_D=a_D+k_{D\ Basis}*v$$

The values for the coefficients $a_P$, $a_I$, and $a_D$ reach the main controllers in the same manner as the $k_{Basis}$ values. The $\underline{a}$ values are preferably also changed whenever the $k_{Basis}$ values are changed.

Within the same production, the coefficients $\underline{a}$, which are likewise individual for the cylinders, and the basic values $k_{Basis}$ may also vary in discrete steps as a function of the circumferential velocity of the cylinders, preferably in only two or three steps over the entire range of velocities.

In an advantageous variant, the coefficients $k_f$ of the upstream filters, the filters 1, 2, 3 and 4, may also be adapted in a controlled manner corresponding to such relations and equations (1) through (3).

The disturbance variable components $du_{i.S}$ are additively sent to the output variables $du_{i.R}$ of the main controllers 31 through 34 in the manner described in connection with FIG. 8.

The output variables of uncoupling members $EG_{34}$, $EG_{234}$ and $EG_{1234}$ are also sent additively. With the first cylinder 11 as the reference cylinder in the exemplary embodiment shown and with the cylinders 12, 13 and 14 following them in their numbering, the uncoupling member $EG_{34}$ is sufficiently for uncoupling the main controller 34 from the main controller 33, and the other uncoupling member $EG_{234}$ is sufficient for uncoupling the main controllers 33 and 34 from the main controller 32. The control members 41 through 44 are also included in the uncoupling.

FIG. 15 shows the case in which the first cylinder 11 prints the reference color. By definition, $Y_{11}$ is zero in this case, and so is $du_{1.R}$. The sending of the disturbance variable acts in this case for the first cylinder 11 in the case of the crop mark only. If the reference color is printed by one of the other cylinders 12, 13 or 14, this also applies to the cylinder now printing the reference color. If a common part appeared in the register deviations $Y_{12}$, $Y_{13}$ and $Y_{14}$ and this common register deviation component happens to be compensated at the first cylinder 11, the reference cylinder, or during crop mark adjustments, the control systems of the cylinders 12, 13 and 14 are uncoupled from the control system of the first cylinder 11 by a corresponding uncoupling member $EG_{1234}$ in the same manner. If the reference cylinder is freely selectable, preferably all the cylinders 11 through 14 are uncoupled from one another via uncoupling members.

As was described above in connection with FIG. 8, the sending of the disturbance variable components $du_{i.S}$ is optional. It is also possible, at least from time to time, to do without the output variables $du_{i.R}$ of the main controllers 31 through 34 if the compensation of the purely systematic errors or of at least part of the systematic errors can be accepted as satisfactory. The formation of a control engineering uncoupling by means of uncoupling members $EG_{34}$, $EG_{234}$ and $EG_{1234}$ is also optional.

Figure 16:
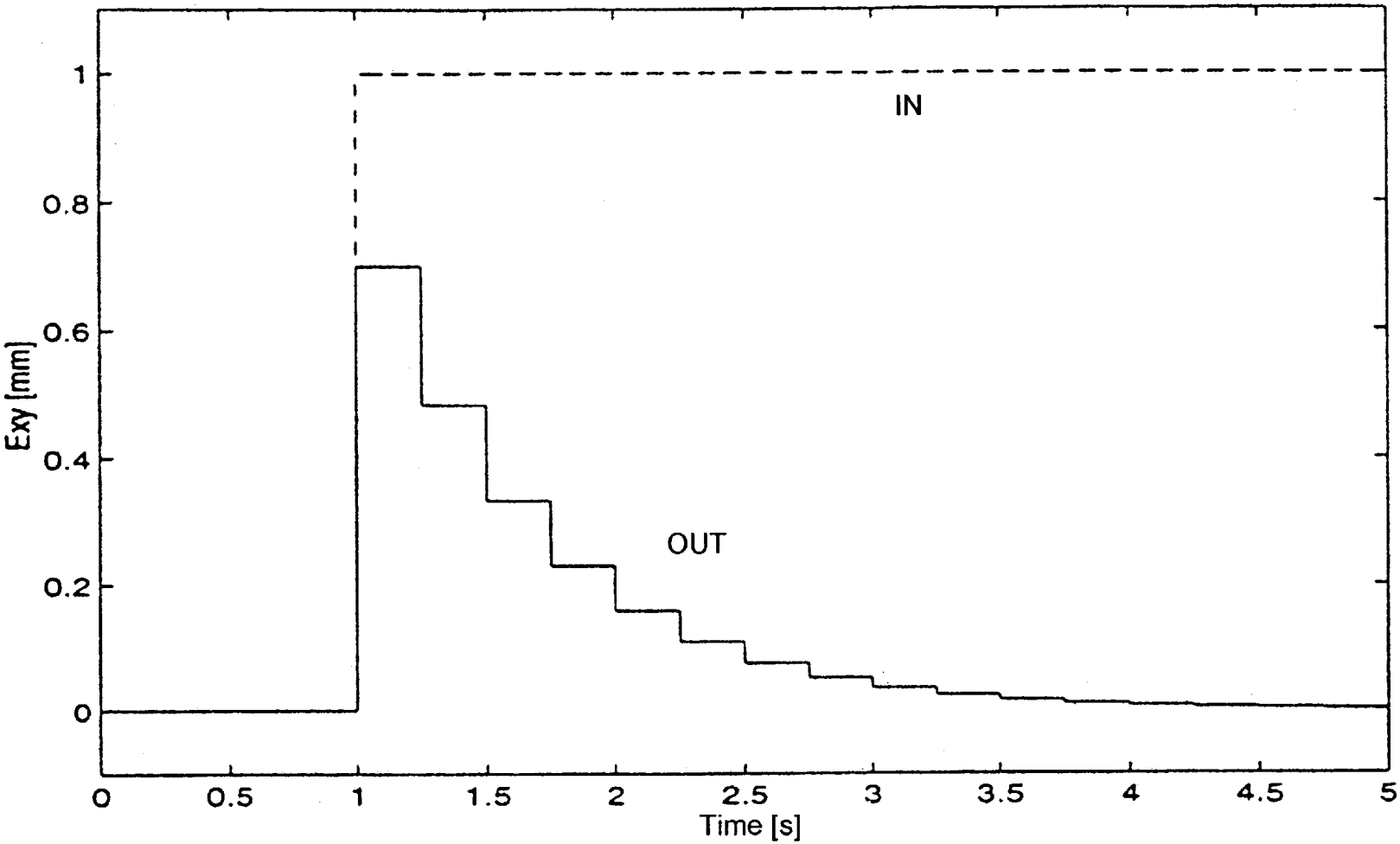
FIG. 16 is a graph of a jump response of an uncoupling member according to FIG. 15.

FIG. 16 shows qualitatively a jump response or transfer function for the uncoupling members $EG_{23}$, $EG_{234}$ and $EG_{1234}$ as a function of the time. The transfer function, which applies to all uncoupling members in this qualitative representation, drops from a positive initial value over the time to zero. Since the control according to the present invention is preferably a discrete control, the shape of the transfer function drops stepwise. The output variables of the uncoupling members are thus formed by the cylinders following each other swinging out such that their registers will change as little as possible if a register adjustment had been performed at a preceding cylinder. The uncoupling of the control systems in the register controller 30 according to the present invention contributes to the registry of cylinders printing on one side of the web among each other also alone, i.e., without the controlled adaptation of the controller parameters and even without the sending of the disturbance variable, i.e., it also offers advantages in terms of registry alone or in an optional combination with one of the other two solutions.

While specific embodiments of the invention have been shown and described in detail to illustrate the application of the principles of the invention, it will be understood that the invention may be embodied otherwise without departing from such principles.

What is claimed is:

1. A process for register coordinating cylinders of a web-fed rotary printing press, the process comprising the steps of:

providing a web;

printing on one side of said web with a first cylinder;

driving said first cylinder with a first motor;

printing on said one side of said web with a second cylinder;

driving said second cylinder with a second motor;

controlling said motors for maintaining preset angular positions of said first and second cylinders, said controlling using motor controllers associated with said motors, mixing a velocity ($v_2$) of one of said cylinders as a disturbance variable with a command variable ($u_{2,Soll}$) for said motor controller of said second cylinder to compensate a register deviation ($Y_{12}$) of said second cylinder from said first cylinder, said register deviation being typical of said disturbance variable (v), said register deviation ($Y_{12}$) is preset as a function of said disturbance variable ($v_2$) in a form of at least one characteristic in order to form a correction variable ($du_{2,S}$), said correction variable is sent to said motor controller of said second cylinder.

2. A process in accordance with claim 1, wherein:

velocity-dependent register deviations are determined and preset for alternative paths of conveyance of the web.

3. A process in accordance with claim 1, wherein:

one of said controllers is a PID controller, during a change in a production condition, one of controller parameters $k_P$, $k_D$, $k_I$, and $k_f$ of said PID controller is changed to coordinate said second cylinder in good register, and a setting of this said controller is adapted to said production condition as a result.

4. A process in accordance with claim 3, wherein:

one of parameter basic values $k_{P\ Basis}$, $k_{D\ Basis}$, $k_{I\ Basis}$, and $k_{f\ Basis}$ of the PID controller is specific to a production and is used to form said one controller parameter ($k_P$, $k_D$, $k_I$, $k_f$).

5. A process in accordance with claim 3, wherein:

said one controller parameter ($k_P$, $k_D$, $k_I$, $k_f$) is affected by a change in a web length as a consequence of a transformation of a print position.

6. A process in accordance with claim 3, wherein:

said one controller parameter ($k_P$, $k_D$, $k_I$, $k_f$) is changed in adaptation to a circumferential velocity of one of said cylinders.

7. A process in accordance with claim 1, wherein:

a third cylinder printing on said one side of the web is uncoupled from a correction of a register deviation ($Y_{12}$) of said second cylinder, said correction being performed for said second cylinder by sending a variable ($du_{2,R}$) for said second cylinder to an uncoupling member $EG_{234}$ and by mixing an output signal ($E_{234}$) of said uncoupling member with a setting variable ($du_{3,R}$) for correcting register deviations ($Y_{13}$) of said third cylinder, said variable bringing about said correction of said register deviation ($Y_{12}$) of said second cylinder.

8. A device for coordinating registration of cylinders of a web-fed rotary printing press which print on a web, the device comprising:

a first cylinder printing on one side of the web;

a first motor driving said first cylinder;

a second cylinder printing on said one side of the web;

a second motor driving said second cylinder;

motor controllers associated with each of said motors for maintaining preset angular positions of said first and second cylinders, a control member forming a correction variable ($du_{2,S}$) from a speed of said cylinders, said speed being used as a disturbance variable (v) for compensating a register deviation ($Y_{12}$) of said second cylinder from said first cylinder, said register deviation ($Y_{12}$) being typical of said disturbance variable, said correction variable being sent to said motor controller of said second cylinder, said control member has a memory including a curve of the register deviation ($Y_{12}$) of said second cylinder from said first cylinder (11), said curve being a function of said disturbance variable (v).

9. A device in accordance with claim 8, wherein:

said control member includes first and second inputs, said disturbance variable (v) is sent to said control member via said first input, one of a characteristic ($Y_{12}(v)$) which is valid for a current print production, and a selection signal for selecting this characteristic from among other characteristics stored in said memory of said control member is sent to said control member via said second input.

10. A device in accordance with claim 8, further comprising:

a PID controller for coordinating in good register said second cylinder with said first cylinder, said controller including one of controller parameters $k_P$, $k_D$, $k_I$, and $k_f$ which is changed during operation of the press.

11. A device in accordance with claim 10, further comprising:

a signal processor and a memory in said controller;

a higher control means for transmitting one of parameter basic values $k_{P\ Basis}$, $k_{D\ Basis}$, $k_{I\ Basis}$, and $k_{f\ Basis}$ to said signal processor and said memory in said controller, said parameter basic values ($k_{P\ Basis}$, $k_{D\ Basis}$, $k_{I\ Basis}$, $k_{f\ Basis}$) forming said controller parameters ($k_P$, $k_D$, $k_I$, $k_f$).

12. A device in accordance with claim 10, wherein:

a circumferential velocity of one of said cylinders is fed into said controller.

13. A device in accordance with claim 12, wherein:

said controller multiplies said circumferential velocity by said parameter basic value ($k_{P\ Basis}$, $k_{D\ Basis}$, $k_{I\ Basis}$, $k_{f\ Basis}$) to form said one controller parameter ($k_P$, $k_D$, $k_I$, $k_f$).

14. A device in accordance with claim 10, wherein:

said control member is part of said controller.

15. A device in accordance with claim 11, wherein:

said control member is independent of said higher control means.

16. A device in accordance with claim 11, wherein: said control member is part of said higher control means.

17. A process for register coordinating cylinders of a web-fed rotary printing press, the process comprising the steps of:

providing a web;

printing on one side of said web with a first cylinder;

driving said first cylinder with a first motor;

printing on said one side of said web with a second cylinder;

driving said second cylinder with a second motor;

providing a characteristic for the printing press relating a typical register deviation of said second cylinder from said first cylinder as a function of velocity of one of said cylinders;

measuring a velocity of one of said cylinders;

determining said typical register deviation from said characteristic based on said measured velocity;

adjusting said driving of one of said first and second cylinders based on said typical register deviation determined from said characteristic.

18. A process in accordance with claim 17, further comprising:

providing a plurality of said characteristics for different conditions of the printing press;

determining said different conditions;

choosing one of said plurality of characteristics based on said determined conditions;

using said one of said plurality of characteristics in said step of determining said typical register deviation.

19. A process in accordance with claim 17, further comprising:

measuring an actual register deviation;

adjusting said driving of said one of said first and second cylinders based on said typical register deviation and said actual register deviation.

* * * * *